US008584385B2

(12) United States Patent
Mayer et al.

(10) Patent No.: US 8,584,385 B2
(45) Date of Patent: Nov. 19, 2013

(54) INTERACTIVE ELECTRONIC GREETING CARDS WITH TAP AND TOUCH ACTIVATED EFFECTS

(75) Inventors: David Mayer, Bay Village, OH (US); Catherine Tasse, Westlake, OH (US); Sarah C. Eklund, Cleveland, OH (US); Allison Marsh, Ravenna, OH (US); Jerry Guo, Shanghai (CN); Tiger Qiao, Shanghai (CN)

(73) Assignee: American Greetings Corporation, Cleveland, OH (US)

( * ) Notice: Subject to any disclaimer, the term of this patent is extended or adjusted under 35 U.S.C. 154(b) by 120 days.

(21) Appl. No.: 13/090,569

(22) Filed: Apr. 20, 2011

(65) Prior Publication Data

US 2011/0258893 A1 Oct. 27, 2011

Related U.S. Application Data

(60) Provisional application No. 61/326,727, filed on Apr. 22, 2010.

(51) Int. Cl.
*G09F 1/00* (2006.01)

(52) U.S. Cl.
USPC ..... 40/124.03

(58) Field of Classification Search
USPC ..... 40/124.03
See application file for complete search history.

(56) References Cited

U.S. PATENT DOCUMENTS

| | | | | |
|---|---|---|---|---|
| 4,200,222 | A * | 4/1980 | Feuer | 229/92.8 |
| 4,748,756 | A * | 6/1988 | Ross | 40/715 |
| 5,135,426 | A * | 8/1992 | Lin | 446/408 |
| 5,504,836 | A | 4/1996 | Loudermilk | |
| 5,956,682 | A | 9/1999 | Loudermilk et al. | |
| 6,084,569 | A * | 7/2000 | Ricotta et al. | 345/156 |
| 6,185,851 | B1 | 2/2001 | Loudermilk et al. | |
| 7,240,442 | B2 * | 7/2007 | Clegg | 40/124.03 |
| 7,356,950 | B1 * | 4/2008 | Avery | 40/124.02 |
| 7,840,017 | B2 | 11/2010 | Isetani et al. | |
| 2002/0040298 | A1 | 4/2002 | Loudermilk et al. | |
| 2002/0046034 | A1 | 4/2002 | Loudermilk et al. | |
| 2005/0287913 | A1 * | 12/2005 | Ellman et al. | 446/384 |
| 2007/0256337 | A1 * | 11/2007 | Segan | 40/124.03 |
| 2009/0126242 | A1 | 5/2009 | Clegg et al. | |
| 2009/0308924 | A1 | 12/2009 | Wallace et al. | |
| 2010/0151830 | A1 | 6/2010 | Raffle | |
| 2010/0250255 | A1 | 9/2010 | Stern | |

* cited by examiner

*Primary Examiner* — Joanne Silbermann
(74) *Attorney, Agent, or Firm* — Christine Flanagan

(57) ABSTRACT

The interactive greeting card of the present disclosure and related inventions combines a traditional paper card with one or more special effects that are initiated by interaction between a user and the greeting card. One or more touch sensors are used to initiate effects including, but not limited to sound, light, movement or a combination thereof.

15 Claims, 4 Drawing Sheets

INTERACTIVE ELECTRONIC GREETING CARDS WITH TAP AND TOUCH ACTIVATED EFFECTS

RELATED APPLICATIONS

This application claims priority to U.S. Provisional Patent Application No. 61/326,727, filed on Apr. 22, 2010, which is incorporated herein by reference in its entirety.

FIELD OF THE INVENTION

The present invention is in the field of personalized greeting devices, greeting cards and social expression products, and more particularly to greeting cards with interactive electronic functions including tap and/or touch sensitive sound or device activation.

BACKGROUND OF THE INVENTION

Traditional paper greeting cards have been widely used for celebratory occasions such as birthdays, graduations, weddings, and for other commercial purposes. More recently, the market has expanded with greeting cards that attempt to capture attention by alternate designs and other features to enhance the communicative and entertainment value of social and relational greetings. The widespread availability of compact digital electronics has made incorporation into social communication products economical. Although the prior art includes greeting cards with sound-generating features, such cards are generally available only in a fixed format wherein a sound file is played upon activation by manipulation of the card. The prior art generally lacks social expression products such as greeting cards with electronic functions with which a user such as a recipient of the card can activate and use in various interactive manners.

SUMMARY OF THE INVENTION

An interactive greeting card comprising a greeting card body having a plurality of greeting card panels, two of the greeting card panels forming and enclosed cavity, an electronics module contained within the enclosed cavity of the greeting card body comprising a circuit board, integrated circuit, touch sensor switch, a speaker, a memory storage device, a power source, a switch, a touch sensor switch plate and at least two digital audio files saved on the memory storage device. A first switch initiates playback of a first digital audio file upon opening the greeting card and a second switch initiates playback of a second digital audio file upon human contact with an area of the greeting card that is directly above the touch sensor switch plate.

DETAILED DESCRIPTION OF PREFERRED AND ALTERNATE EMBODIMENTS

The interactive electronic greeting card of the present disclosure and related inventions combines a traditional paper greeting card with one or more special effects that are initiated by interaction between a user and the greeting card. One or more touch sensors (hereinafter referred to interchangeably as "touch sensor", "touch switch", "touch sensitive switch" and "touch sensitive sensor") are used to initiate effects including, but not limited to sound, light and/or movement. For the purpose of describing the invention, the embodiments described herein are directed to greeting cards with touch activated sound, however, it should be noted that the scope of the invention includes other touch activated effects such as light, motorized movement, and other such effects, or a combination thereof.

Figure 1:
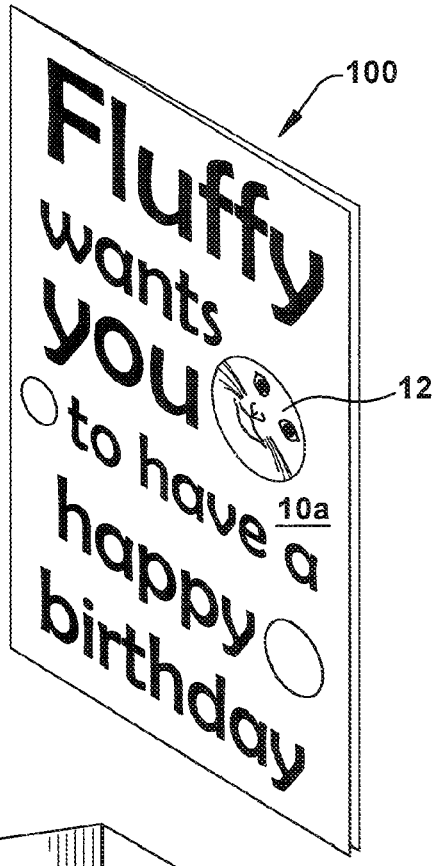
FIG. 1 is a perspective view of a representative embodiment of an interactive greeting card of the present invention, in a closed position.
Figure 2:
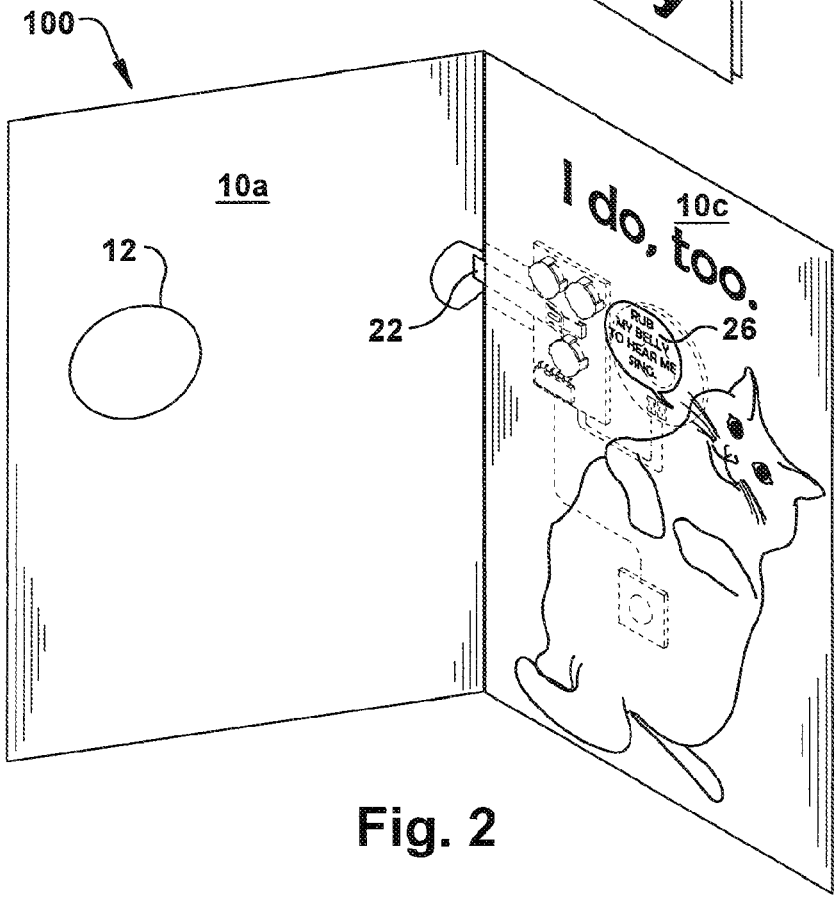
FIG. 2 is a perspective view of the interactive greeting card of FIG. 1, in an open position.
Figure 3:
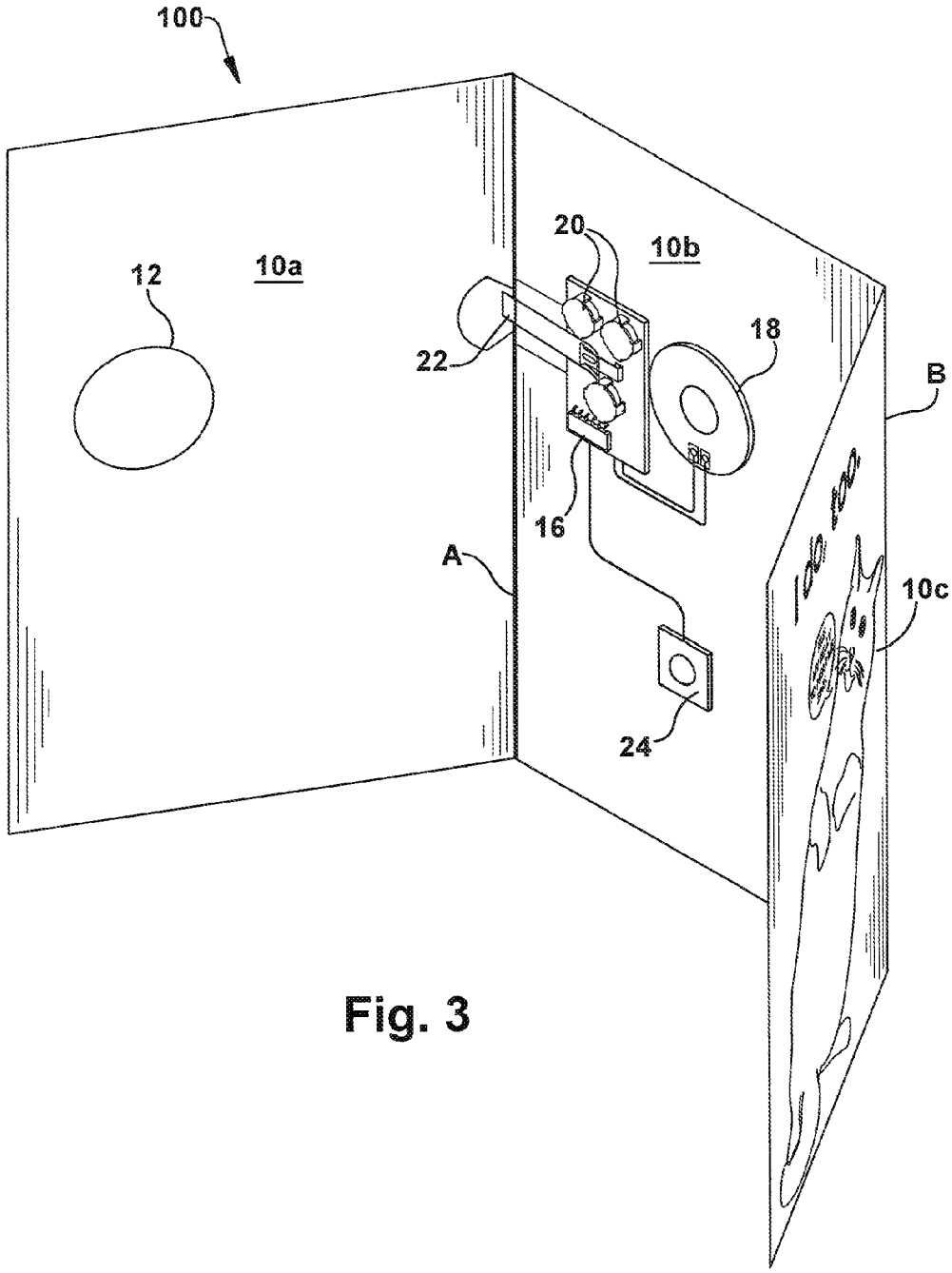
FIG. 3 is a perspective view of the interactive greeting card of FIG. 1, in a semi-assembled position.
Figure 4:
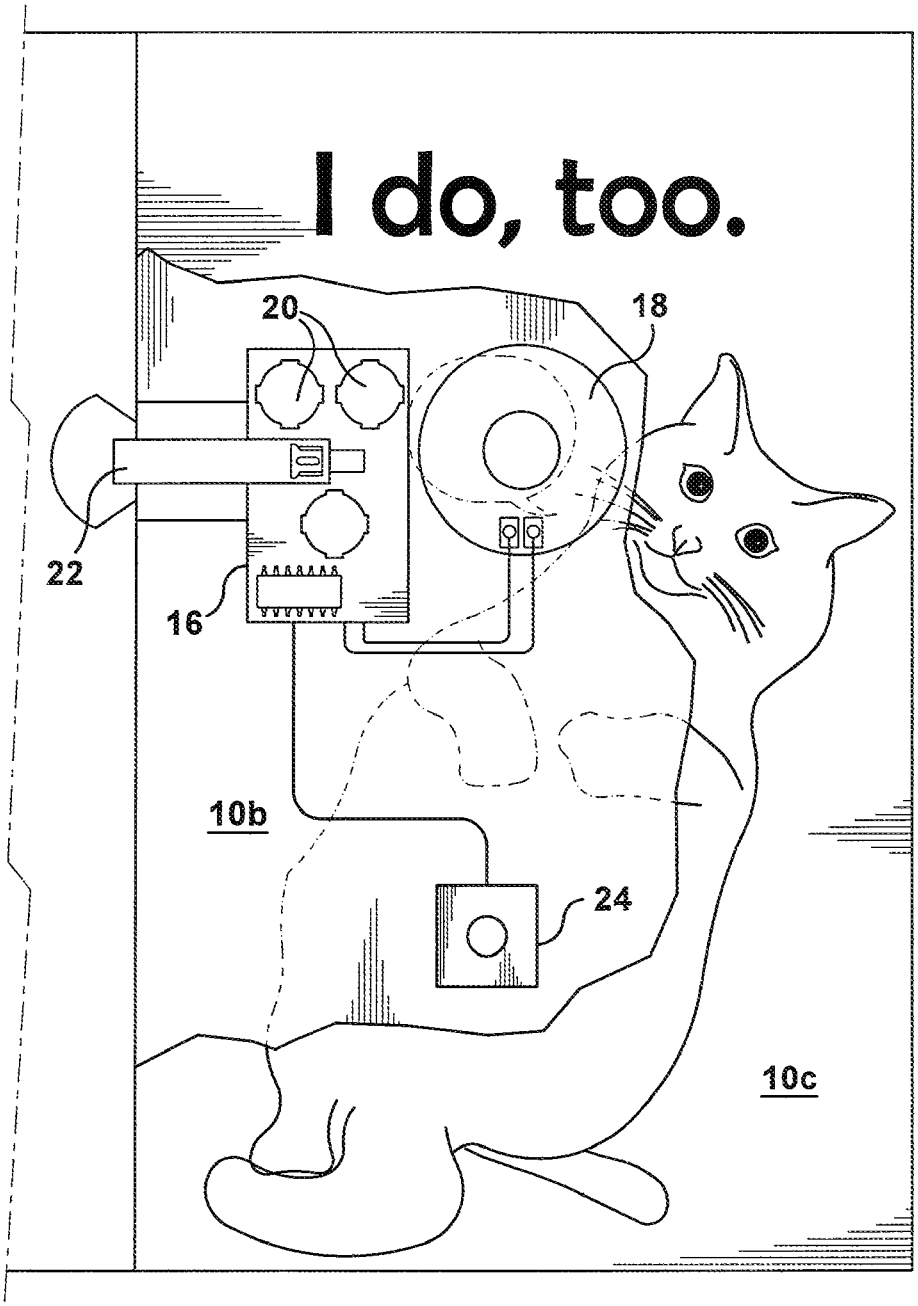
FIG. 4 is a front view of the interactive greeting card of FIG. 1 with tear-away.

In a preferred embodiment, the greeting card body includes a first panel 10*a* connected to a second panel 10*b* along a first fold line A and a third panel 10*c* connected to the second panel 10*b* along a second fold line B, as shown in FIG. 3. The greeting card panels 10*a*, 10*b*, 10*c* may be made of paper, paperboard, cardboard, or any other suitable material. Each of the panels contains a front surface and a back surface opposite the front surface. Various electronic components are attached to back surface of either the second 10*b* or third panel 10*c*. Once the electronic components are installed, the third panel 10*c* is folded over the second fold line B to lie atop the second panel 10*b*. The third panel 10*c* is then sealed, adhesively or otherwise, to the second panel 10*b* around each of the outer edges of the panel, thereby forming an enclosed cavity therebetween, as shown in FIG. 4. The electronic components are then contained and concealed within the cavity formed between the second 10*b* and third panels 10*c*. The greeting card 100 then operates as a typical two panel greeting card with the first panel 10*a* serving as the front panel and the attached second 10*b* and third 10*c* panels serving as the back panel, as shown in FIGS. 1 and 2.

Figure 5:
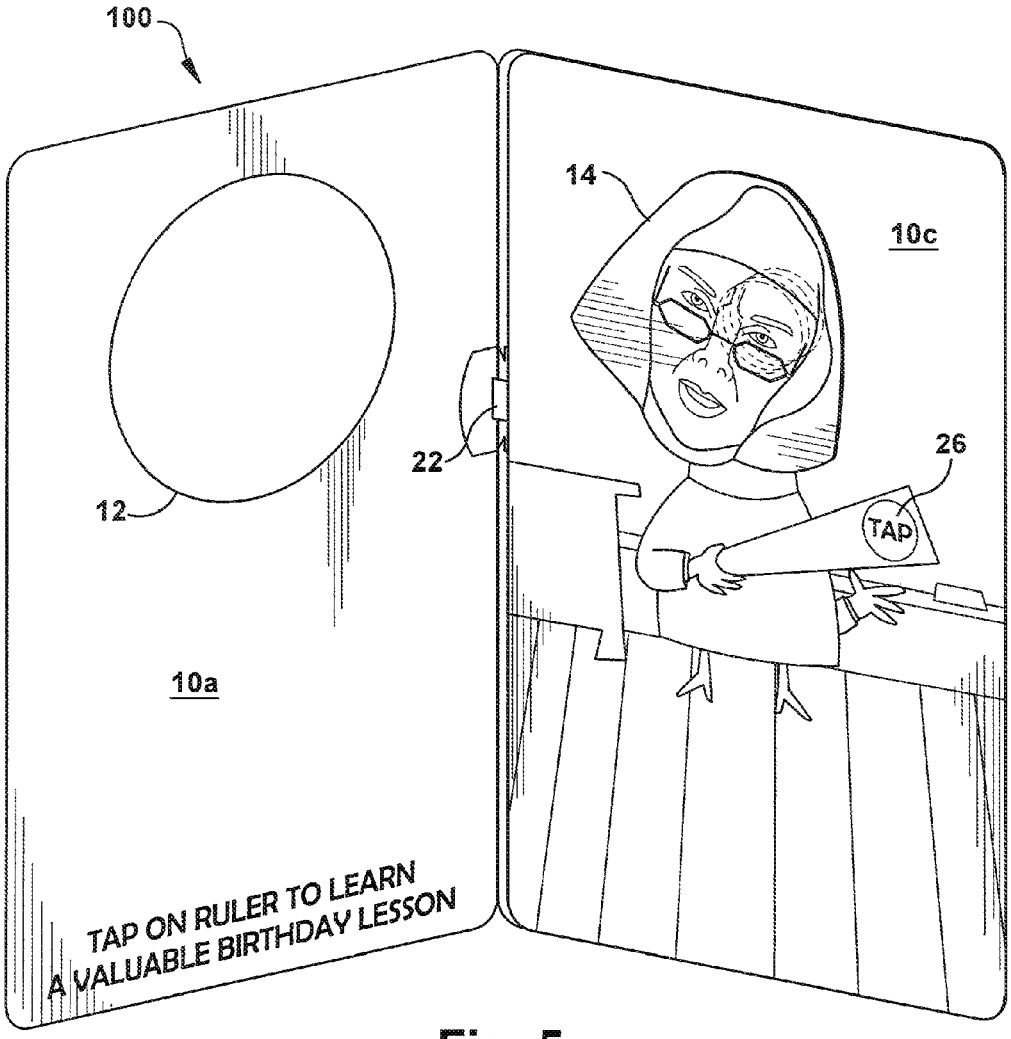
FIG. 5 is a perspective view of another embodiment of the interactive greeting card of the present invention.

The greeting card 100 is folded along the first fold line A so that the back surface of the front panel is facing the back surface of the back panel. To open the greeting card 100, the front panel is moved away from the back panel about the first fold line A and likewise (FIG. 2), to close the greeting card 100 front panel is moved towards the back panel along the first fold line A so that the panels 10*a*, 10*b*, 10*c* return to a stacked position (FIG. 1). While the representative embodiment of the greeting card 100 contains three panels 10*a*, 10*b*, 10*c* connected along two fold lines A, B, the greeting card body may contain any number of panels and fold lines that cooperate to form at least one internal cavity wherein the electronic components may be concealed. Additional features may be included in the greeting card body such as an opening or aperture 12 in the front panel 10*a* of the greeting card 100 that allows visibility to a portion of the inside or back panel 10*c* of the greeting card 100. The greeting card panels may also contain various embellishments, such as one or more separate die cut pieces 14 that are attached to the greeting card body to give the artwork a three-dimensional effect, as shown in FIG. 5. The one or more die cut pieces 14 may be attached to the greeting card body by a stationary piece of foam or other attachment mechanism that spans between the greeting card body and the die cut piece 14 or by a spring so that the die cut piece 14 can appear to bounce or bobble.

The electronic components (referred to collectively as "electronics module") of the greeting card 100 are concealed within the body of the greeting card 100, as described above. The electronics module contains various electronic components that are operative to initiate sound or other special effect upon contact with a touch sensor. The electronics module may contain components including, but not limited to, a circuit board with integrated circuit and controller 16, an integrated circuit with touch sensor, a speaker 18, a memory device, a power source 20, a switch 22, and a sensor switch plate 24. In a preferred embodiment, the sensor is a capacitance touch switch (hereinafter referred to interchangeably as "touch sensor", "touch switch"), which senses a change in the capacitance when a user (human) comes in contact with the switch plate surface 24 or an overlying material such as a panel of a card. When a user touches an area on the greeting card 100 directly above the switch plate 24, an increase in capacitance is detected thereby triggering the switch. Other types of touch sensitive switches may be used including a resistance touch switch or electronic ink. Also, other electronic components and related circuitry, which are known to one skilled in the art, may also be included.

In one embodiment, the interactive greeting card contains at least two digital audio files (hereinafter referred to interchangeably as "digital audio file", "audio file", "audio message", "message", or "recording") which are pre-loaded and stored within the electronics module. The digital audio files may contain a voice message, music, sounds or any other type of audio. A first digital audio file is automatically replayed upon opening the greeting card. A slide switch 22 is used to initiate playback of the first audio message. The slide switch 22 is located across the first fold line A between the first 10*a* and second 10*b* greeting card panels. When the greeting card 100 is in a closed position, with the first greeting card panel 10*a* atop the second greeting card panel 10*b*, the slide switch 22 prevents the completion of the circuit. When the greeting card 100 is opened by moving the first panel 10*a* away from the second panel 10*b* along the first fold line A, the slide switch 22 completes the circuit, initiating playback of a first audio file. The first digital audio file may contain spoken instructions informing the user where to touch the greeting card 100 to initiate playback of a second message or recording. For example, if the greeting card 100 contains a picture or drawing of a particular character, such as a celebrity or public figure, the initial audio file, which is triggered upon the user opening the greeting card 100, may contain a short message in the voice of the celebrity or public figure instructing the user where to touch, tap or otherwise contact the greeting card 100 to initiate the replay of a second message or recording. The second audio file may contain sound, music, or a second message in the voice of the celebrity or public figure.

The greeting card 100 may contain a sticker or printed indicia (hereinafter referred to as "touch indicator") 26 indicating where on the greeting card 100 a user should touch in order to receive a second message or playback of a second audio file. This touch indicator 26 may be placed directly above the touch sensor switch plate 24 (shown in FIG. 5) or it may be contained anywhere on the greeting card 100 as long as it directs the user to the portion of the greeting card 100 that must be touched in order to initiate the second message. If the touch indicator 26 is placed directly above the switch plate 24 (FIG. 5), then the surface area of the switch plate 24 is larger than the touch indicator 26 so that a touch or tap on or very near to the touch indicator 26 results in playback of the second audio file. A single touch or tap on the touch indicator 26 initiates playback of the second message. In a preferred embodiment, in order for playback of the second message, greeting card 100 must be in an open position. Therefore, if the second message has been initiated by a tap on the touch indicator 26, the second message will continue to completion unless the greeting card 100 is closed during playback. This prevents playback of the second message before the first message by inadvertent or accidental contact with the touch sensor switch plate 24. Also, initiation of the second audio message (by touching or tapping the indicated area) will cause the first audio message to cease if the second audio message is initiated before the first audio message is complete.

In another embodiment, instead of a single touch or tap initiating playback of the second audio file, as described above, the touch sensor requires constant user interaction to replay the entirety of the second audio file. For example, if the greeting card 100 contains a picture of a cat or dog, the first audio file (initiated by a slide switch 22 upon opening the greeting card) may contain sounds of a cat meowing or a dog barking. A touch indicator 26 printed on the greeting card may instruct the user to "rub my belly" or "pet me" at a specific position on the greeting card 100. When the user rubs this area, the second audio file is played back, which may include a cat meowing or dog barking to the tune of "Happy Birthday". However, the user must continue to rub or continuously touch the area of the touch indicator 26 to keep the second audio message playing. If the user stops rubbing the card in the indicated area, the second audio message will stop. If the user then starts to rub the area again, the audio will pick up where it left off when the user ceased contact. If the user stops rubbing the area and closes the card, the second audio will start back at the beginning when the greeting card is re-opened and contact is then re-initiated. If the user opens the card and begins rubbing the card as directed by the touch indicator 26, the second message will continue playing on a loop as long as the user continues contact with the touch sensor. In this embodiment, a single touch or tap on area directed by the touch indicator 26 is not enough to initiate playback of the second audio file. A user must rub or apply continual movement of a finger or fingers over the touch indicator area to continue playback of the second audio file. As described above, the slide switch 22 must complete the circuit (greeting card in an open position) in order for either the first or second audio message to play. This prevents inadvertent playback of the second message prior to playback of the first message. Also, initiation of the second audio file (by rubbing the indicated area) will cause the first audio file to cease if the second audio file is initiated before the first audio file is complete.

In an alternate embodiment, the volume or speed of the second audio message may be increased or decreased depending on the speed at which the user rubs (or otherwise provides a constant back and forth motion) over the surface of the greeting card at the touch indicator. For example, the greeting car may contain a picture or drawing of a guitar on the touch indicator. The user must rub or "strum" the guitar in order to hear the second audio file. If the user rubs in a fast, quick paced motion, the volume of the guitar and/or the speed of the music will be fast and quick paced. Decreasing the speed at which the user rubs or strums the guitar, will cause the audio to decrease in speed and/or volume.

In still another embodiment, the interactive greeting card contains a plurality of touch sensors and a plurality of corresponding digital audio files. Touching on certain areas of the card will trigger different audio message. For example, the greeting card may contain artwork showing several different animals. Beneath each animal is a different touch sensor switch plate. When the user touches a particular animal, the sound the animal makes is played back. Selecting a different animal will reveal a different sound.

In yet another embodiment, the interactive greeting card may contain additional electronic components such as a microphone, to enable a user to record a personal message that is saved played back upon the user touching a specific indicated area of the greeting card.

Other switches may be used in addition to or in place of a slide switch, such as a magnetic switch, wherein two magnets are placed on the first and second greeting card panels. When the magnets are in contact, such as when the greeting card is in a closed position, the circuit is broken. When the magnets are no longer in contact, such as when the greeting card is opened, the circuit is completed, triggering playback of the second audio file. Other switches may be used as well, such as a light sensitive switch or contact switch.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. An interactive greeting card comprising:

a greeting card body having a plurality of greeting card panels, two of the greeting card panels forming an enclosed cavity;

an electronics module contained within the enclosed cavity of the greeting card body, the electronics module operative to save and playback at least two digital audio files;

wherein playback of one of the at least two digital audio files is triggered by a user interacting with a specified area of the greeting card and wherein continuous back and forth motion_is required to continue hearing playback of the one of the at least two digital audio files; and wherein an increase in the speed of the continuous back and forth motion increases the speed and volume of the audio.

2. The interactive greeting card of claim 1 further comprising a slide switch.

3. The interactive greeting card of claim 1, wherein one of the at least two digital audio files contains spoken instructions indicating where to touch the greeting card to initiate the other digital audio file.

4. The interactive greeting card of claim 1, wherein the greeting card contains printed indicia indicating where to touch the greeting card to initiate one of the at least two digital audio files.

5. The interactive greeting card of claim 1, wherein the greeting card must be in an open position for playback of one of the at least two digital audio files.

6. The interactive greeting card of claim 1, wherein one of the greeting card panels contains an aperture through which an inside surface of the greeting card is visible.

7. An interactive greeting card comprising:

a multi-panel greeting card body having an enclosed cavity between two panels thereof;

an electronics module contained with the enclosed cavity, the electronics module operative to store and playback two or more digital audio files;

wherein a slide switch initiates playback of one of the two or more digital audio files, and wherein a user applying a continuous back and forth motion to an area of the greeting card proximate to the touch sensor switch plate initiates playback of one of the two or more digital audio files and when the user stops the continuous back and forth motion, the one of the two or more digital audio files ceases playback and wherein an increase in the speed of the continuous back and forth motion increases the volume of the audio.

8. The interactive greeting card of claim 7, wherein the slide switch is located across the first fold line and is triggered when the greeting card is opened by unfolding the first panel away from the second panel along the first fold line.

9. The interactive greeting card of claim 7, wherein an increase in the speed of the continuous back and forth motion increases the speed of the audio.

10. The interactive greeting card of claim 7, wherein the slide switch initiates playback of a first of the two or more digital audio files containing verbal instructions on wherein to apply the continuous back and forth motion on the greeting card to initiate playback of a second of the two or more digital audio files.

11. The interactive greeting card of claim 7, wherein the greeting card body contains printed indicia thereon indicating where to apply the continuous back and forth motion on the greeting card to initiate playback of one of the at least two digital audio files.

12. An interactive greeting card comprising:

a greeting card body having at least three panels;

an electronics module contained within a cavity formed between two of the at least three panels of the greeting card body, the electronics module operative to store and playback at least one audio file;

a touch sensor switch plate located beneath one of the at least three panels of the greeting card;

wherein playback of the at least one audio file occurs only while a user continuously rubs an area of the greeting card above the touch sensor switch plate, and wherein an increase in the speed of the continuous rubbing increases the volume of the audio.

13. The interactive greeting card of claim 12, wherein playback of the at least one audio file stops as soon as the user stops the rubbing motion on the area of the greeting card above the touch sensor switch plate.

14. The interactive greeting card of claim 12 wherein an increase in the speed of the continuous back and forth motion increases the speed of the audio.

15. The interactive greeting card of claim 14, wherein if the rubbing motion is re-initiated without closing the greeting card, playback of the at least one audio file will start where it left off when the user ceased the rubbing motion.

* * * * *